United States Patent [19]

Lin

[11] Patent Number: 5,047,189

[45] Date of Patent: Sep. 10, 1991

[54] PROCESS FOR PREPARING PARTIALLY DISSOLVABLE AND SPLITTABLE CONJUGATED MICROFIBER

[75] Inventor: Chen-Ling Lin, Taipei, Taiwan

[73] Assignee: Nan Ya Plastics Corporation, Taipei, Taiwan

[21] Appl. No.: 500,961

[22] Filed: Mar. 29, 1990

[51] Int. Cl.[5] ..... D01D 5/26; D01D 5/36

[52] U.S. Cl. ..... 264/103; 264/148; 264/151; 264/171; 264/211.15; 264/210.7; 264/210.8; 264/211.17; 264/234; 264/345

[58] Field of Search ..... 264/103, 171, 210.8, 264/210.7, 151, 148, 211.15, 211.17, 234, 235.6, 345

[56] References Cited

U.S. PATENT DOCUMENTS

| | | | |
|---|---|---|---|
| 3,853,977 | 12/1974 | Matsui et al. | 264/171 |
| 3,916,611 | 11/1975 | Matsui et al. | 264/171 |
| 4,369,156 | 1/1983 | Mathes et al. | 264/171 |
| 4,381,274 | 4/1983 | Kessler et al. | 264/171 |
| 4,447,489 | 5/1984 | Linhart et al. | 264/171 |
| 4,460,649 | 7/1984 | Park et al. | 264/171 |

FOREIGN PATENT DOCUMENTS

| | | | |
|---|---|---|---|
| 0048453 | 3/1982 | European Pat. Off. | 264/171 |
| 48-28005 | 8/1973 | Japan | 264/171 |
| 54-151618 | 11/1979 | Japan | 264/171 |

OTHER PUBLICATIONS

Article titled "LOY-MOY-POY-HOY-FOY?", by H. Treptow, Man-Made Fiber Year Book (CTI), 1986, p. 6.

*Primary Examiner*—Hubert C. Lorin

*Attorney, Agent, or Firm*—Lowe, Price, LeBlanc & Becker

[57] ABSTRACT

There is provided a process for preparing a partially-dissolvable and splittable conjugated microfiber with a cross-section having a matrix comprising orange-wedge shaped islands slightly connected with each other at the tips of the islands at a common matrix center. The conjugated fibers can be made into filaments and staple fibers. Filaments are spun, taken-up and then textured by means of a belt nip twister. The resulting texture yarns may then be partially dissolved, following weaving, to split. Staple fiber is processed into a non-woven fabric or, by spinning, to spun yarn and then by weaving thereof. The staple fibers can be made into fabrics such as suede fabrics, water-resistant and humidity-permeable high density fabrics, and peachskin fabrics.

3 Claims, 3 Drawing Sheets

PROCESS FOR PREPARING PARTIALLY DISSOLVABLE AND SPLITTABLE CONJUGATED MICROFIBER

FIELD OF THE INVENTION

This invention relates to a process for preparing a partially dissolvable and splittable conjugate fiber.

BACKGROUND OF THE PRIOR ART

The processing of filaments of synthetic fibers, such as for example, PET, PP, PA and the like made by a melt spinning method typically includes the steps:

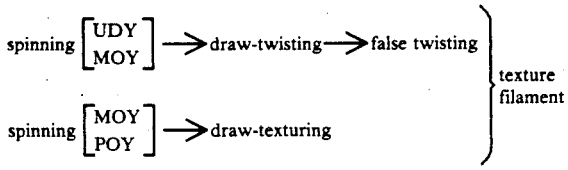

and the processing of staple fibers is:

spinning→drawing→heatsetting→crimping→drying→cutting to staple fiber

In general, for synthetic leathers to have a genuine leather-like soft surface touch, a titer thereof should be at least below 0.4 d. However, fibers of 0.4 d or less can not be produced by a conventional spinning method mentioned above. Even if fibers below 0.4 d can be produced it is difficult to process them by the application of weaving. There are many types of conjugated fibers. FIG. 1A is a cross-sectional view of conjugated fibers produced by Kanebo, Japan, FIG. 1B is a cross-sectional view of conjugated fibers produced by Teijin, Japan, and FIG. 1C is a cross-sectional view of conjugated fibers produced by Toray, Japan.

Conjugated fibers of each of FIGS. 1A and 1B are of matrix types and are made by conjugated spinning of two different kinds of polymer. But these two types can be put to the production of flat yarns only and they can not be used in false twisting. If they are used in false twisting, it is easy for them to split, said this results fluff and in difficulty in weaving. The conjugated fibers of FIG. 1C is of a sea and islands type, and is also made by conjugated spinning of two different kinds of polymers. The sea component should be completely dissolved to obtain the finer ingredient fibers of island. Because to the sea component should be dissolved completely, the cost is increased.

SUMMARY OF THE INVENTION

The present invention is directed to an improvement to overcome the above-mentioned disadvantages, and the improvement is characterised in that the production and the spinning steps are like those in forming a regular yarn, with a dissolving and splitting step performed following the spinning.

A more complete understanding of these and other features and advantages of the present invention will become apparent from a careful consideration of the following detailed description of preferred embodiments illustrated in the accompanying drawings.

DESCRIPTION OF THE PREFERRED EMBODIMENT

The process according to the present invention is as follows.

Figure 1A:
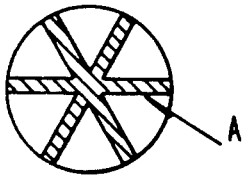
FIG. 1A (PRIOR ART)
FIG. 1A is a cross-sectional view of conjugated microfibers obtained from Kanebo, Japan.
Figure 1B:
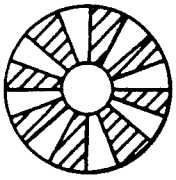
FIG. 1B (PRIOR ART)
FIG. 1B is a cross-sectional view of known conjugated microfibers obtained from Teijin, Japan.
Figure 1C:
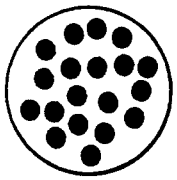
FIG. 1C (PRIOR ART)
FIG. 1C is a cross-sectional view of known conjugated microfibers obtained from Toray, Japan.
Figure 2:
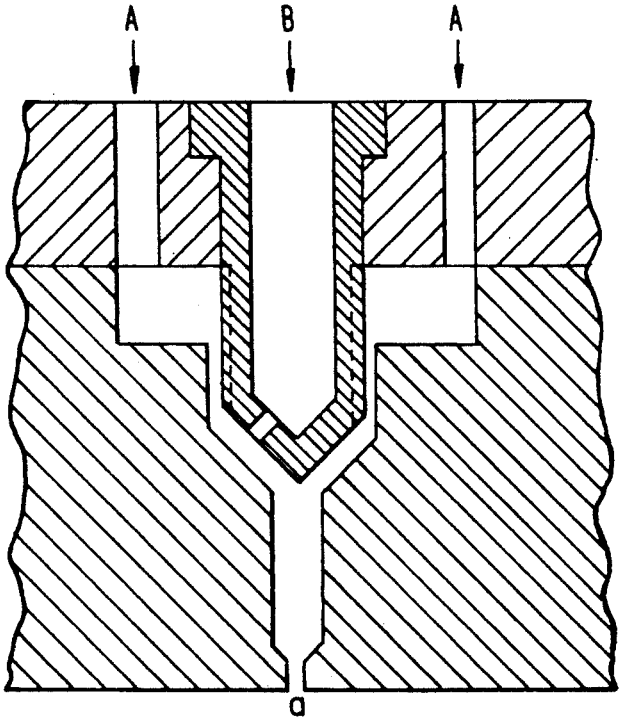
FIG. 2 is a schematic diagram of a spinneret according to a preferred embodiment of the invention.

Polyester (PET) and polyamide (PA), the starting materials of the invention, in a ratio of polyester/polyamide of 20–80/80–20, are extruded through an extrusion apparatus of a spinneret illustrated in FIG. 2. Fibers produced by said apparatus have a cross-section comprising a matrix appearance having orange-wedge shaped islands and connected slightly at the matrix center. These islands can be in a group of 3 to 12 islands in accordance with the design of the spinneret. Conjugated fibers of the invention come out from the bores (A) of the spinneret FIG. 2 at a temperature of 270° to 300° C. During spinning, the dynamic viscosity is 2000 to 3500 poises in the case of polyester and 800 to 2500 poises in case of polyamide. An appropriate take-up speed is 500 to 4000 m/min and a draft ratio is 50 to 500. As shown in FIG. 3, the resultant un-drawn conjugated yarn has a matrix with a cross-section comprising orange-wedge shaped islands. The number of the orange islands is from 3 to 12.

Figure 4:
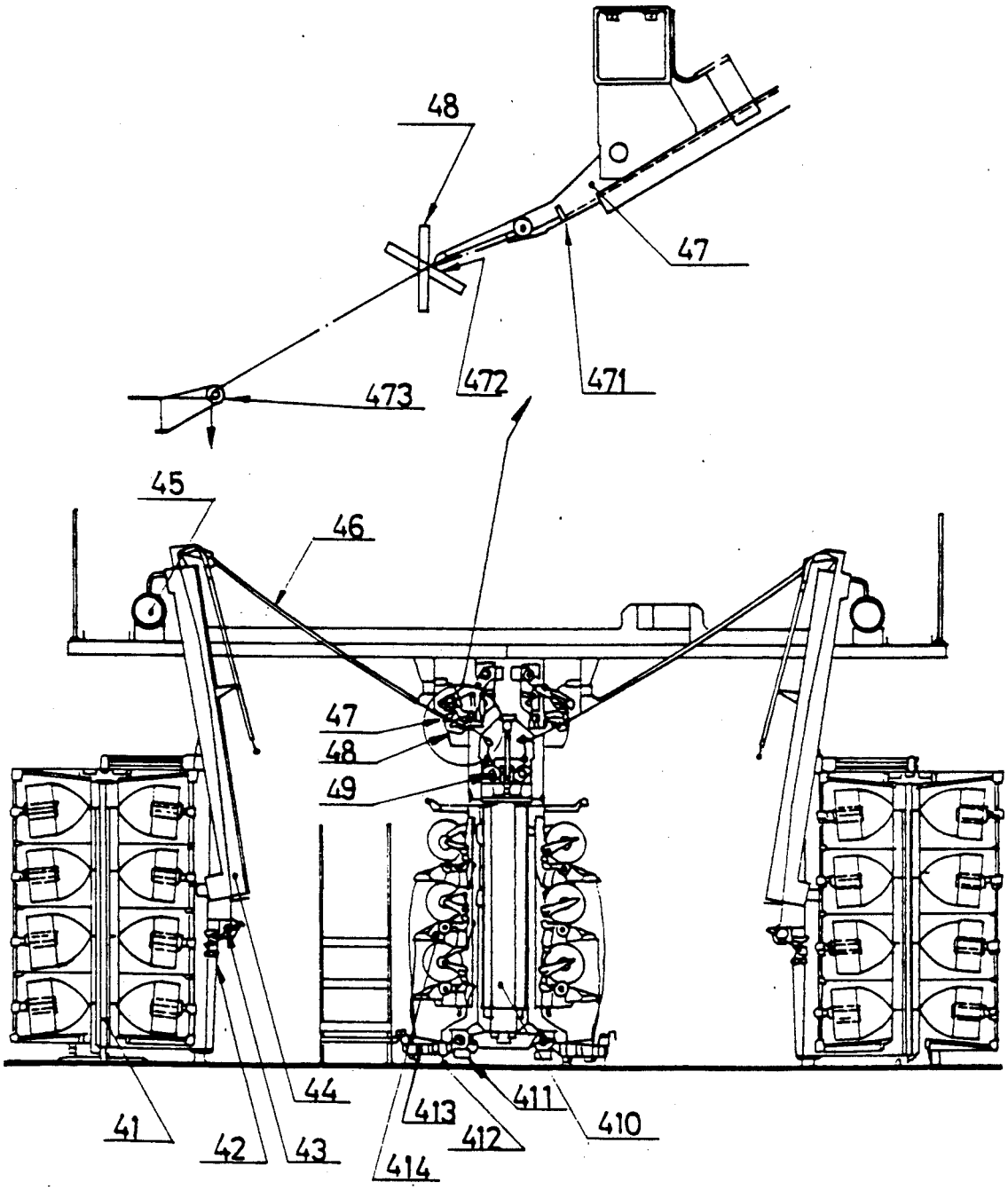
FIG. 4 is a flow chart explaining an apparatus for finishing of the conjugated yarn according to this invention by means of a belt nip twister.

The un-drawn yarn obtained by spinning the conjugate filament is subjected to the following procedures. As shown in FIG. 4, the undrawn yarn cake is taken up on a creel 41 through a high speed belt nip twister, and then passes through a yarn cutter 42 to be introduced into a first feed roller 43. It then passes through a primary heater 44 at a temperature of 100° to 180° C., a ballon control plate 46, a short ballon control bar 47 and a yarn wire guide 471, a pre-twister guide 472, and thereafter, is fed into a nip twister 48 having a twist level of 3000 to 4000 T/M and a twister cross angle of 110 to 130 degree. After passing through a self-force twisting bearing roller 473, the yarn is fed into a second feed roller 49 at a draw ratio (a ratio of the speed of 43 to the speed of 49) between 1.5 and 4.5 and a B/Y ratio (belt speed/yarn speed) between 1.62 and 2.2, and passes through a secondary heater 410 and a third feed roller 411. The second feed roller overfeeds 1.5 to 2.5% and the third feed roller overfeeds 2.0 to 3.5%. Following passage through a yarn feeler 412, an oil roller 413 and a winder 414, the yarn is taken up as conjugated texture yarn having a titer from 30 to 450 d, and a filament count from 12 to 128.

After weaving or knitting of the conjugated texture yarn of the invention into a cloth, it should be subresolved, i.e., the outermost portion of the polyester dissolved to split. A sub-resolving ratio, defined as:

$$\text{subresolving ratio} = \frac{\text{weight of unsplit yarn} - \text{weight of split yarn}}{\text{weight of unsplit yarn}}$$

usually is in the range of 10 to 40% depending on the type of finished fabric. The desired sub-resolving ratio of raised fabrics is between 10 to 20%, that of high density fabrics between 15 to 40%, and of peach skin fabrics is between 10 to 30%. Following dissolving of the outermost portion of the polyester for splitting, the titer per single filament is in the range of 0.01 to 0.5 wherein it comprises polyamide and polyester. Raised fabrics have a suede leather-like feel. In case of high density fabrics, such a fabric can be used as a water-resistant and humidity permeable fabric suitable for making jackets, coats, casual wear clothing and the like. Following buffing of the fabrics to obtain a peach skin feel, it can be used in forming ladies wear, skirts, slacks and the like.

Figure 3B:
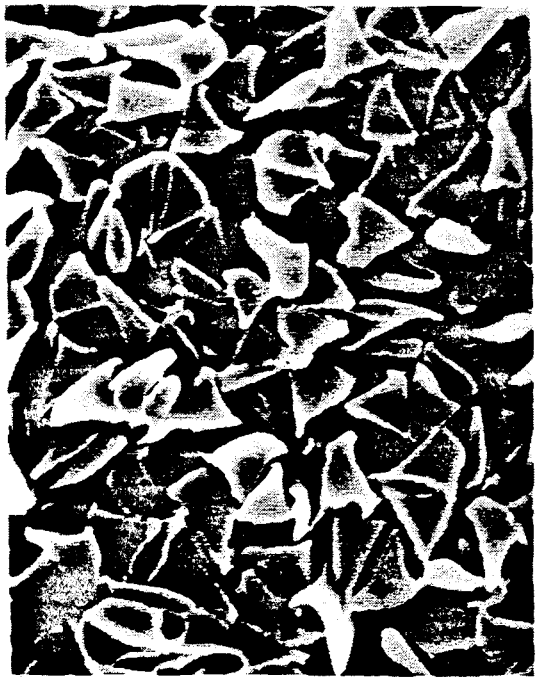
FIG. 3B is a cross-sectional view of the fiber per FIG. 3A according to the invention after splitting.
Figure 3A:
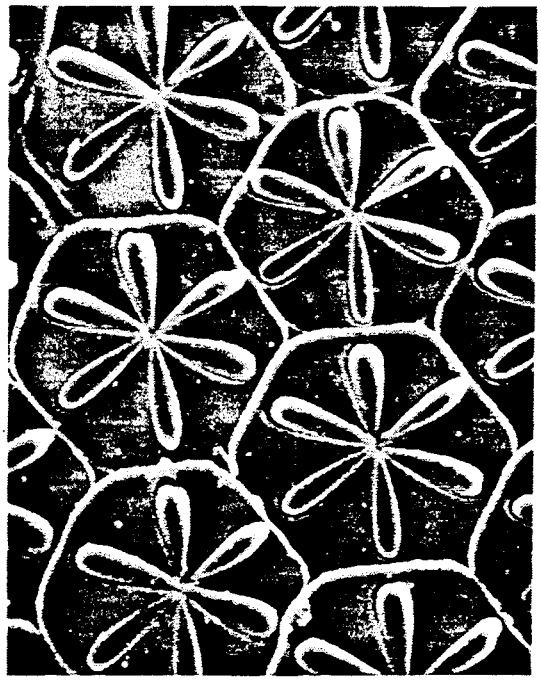
FIG. 3A is a cross-sectional view of a fiber produced according to the invention before splitting.

The microfiber of the invention will be un-splittable during the process of conjugate spinning and twisting. The fiber will not split until following weaving or knitting, i.e., until the sea component of the fiber of the cloth is sub-resolved. A cross-section of the fiber before sub-resolution is shown in FIG. 3A and that afterwards is shown in FIG. 3B.

The process of the invention can also find application in the manufacture of a staple fiber. The same spinneret as in FIG. 2 is employed. It has a hole number of 200° to 300° C.; a through-put temperature of 270° to 300° C., a dynamic viscosity of polyester during the melt spinning process is between 2000 and 3500 poises and that for polyamide being is 800 to 2500 poises, and a winding speed of 500 to 1500 m/min. The resultant fiber is an un-drawn spin tow of conjugated fiber with a cross section of matrix having orange-wedge shaped islands of one material in a sea of another material as shown in FIG. 3A. After being subjected to the processing procedure of FIG. 5, with a draw ratio of 3.0 to 4.5, a drawing temperature of 70° to 120° C., a heat setting temperature of 40° to 150° C. and a drying temperature of 60° to 130° C., the drawn tow of conjugated fiber is formed into a drawn crimped conjugated staple fiber of 0.5 to 5 d having a length of 32 to 102 mm. The resulting conjugated staple fiber can be put to non-woven use or used for spinning into 20 to 45 s spun yarn.

The woven fabrics made of the fiber of the invention may be fabrics ranging from heavy to light. These fabrics can be made into jackets, coats, skirts, pants, suits, slacks, vests, gloves and the like. Besides they can find use in wiping cloth, glass-cleaning cloth, car-cleaning cloth, and cleaning cloth for optical instruments and integrated circuits. They may also be manufactured into a product of manufacture, such as an ultrafine filter, printing ribbon, synthetic leather, shoes, handbags and suitcases, and the like.

EXAMPLES

EXAMPLE 1

The production and the yield are normal while conjugated spinning under the following conditions. Polyester and nylon-6 are subjected to conjugated spinning at a temperature of 285° C., extruding through a spinneret having a hole number of 32, a through-put speed of 10 m/min, a through-put mass rate of 0.9 g/min-hole and a winding speed of 1500 m/min; a dynamic viscosity of PET being 2500 poise and that of nylon being 1500 poise. The resultant un-drawn conjugated filament has a fineness of 173 d. The parameters of the undrawn filament being twisted by means of the belt nip twister, as shown in FIG. 4, are as follows.

Texturing machine: MACH CRIMPER 33II (TM)
Speed: 500 m/min
Draw ratio: 2.3
Drawing temperature: 140° C.
B/Y ratio: 1.8
Second overfeed: 2.0%
Third overfeed: 2.5%
Twist level 3500 T/M
Belt cross angle: 115°

The draw-texture yarn obtained from the above-mentioned twisting has a tenacity of 4.1 g/d, an elongation of 30%, a boiling water shrinkage (BWS) of 11% and a crimp rigidity (CR) of 15%.

EXAMPLE 2

Polyester and nylon-6 are subjected to conjugated spinning at a temperature of 280° C., extruding out through a spinneret having a hole number of 280, a through-put rate of 2.67 m/min, a through-put mass rate of 1 g/min, a take-up speed of 1200 m/min and a spin denier of 7.5 d; a dynamic viscosity of PET being 1500 poise and that of nylon-6 also 1500 poise. An un-drawn spin-tow is produced by conjugated spinning performed under the aforementioned spinning condition.

Figure 5:
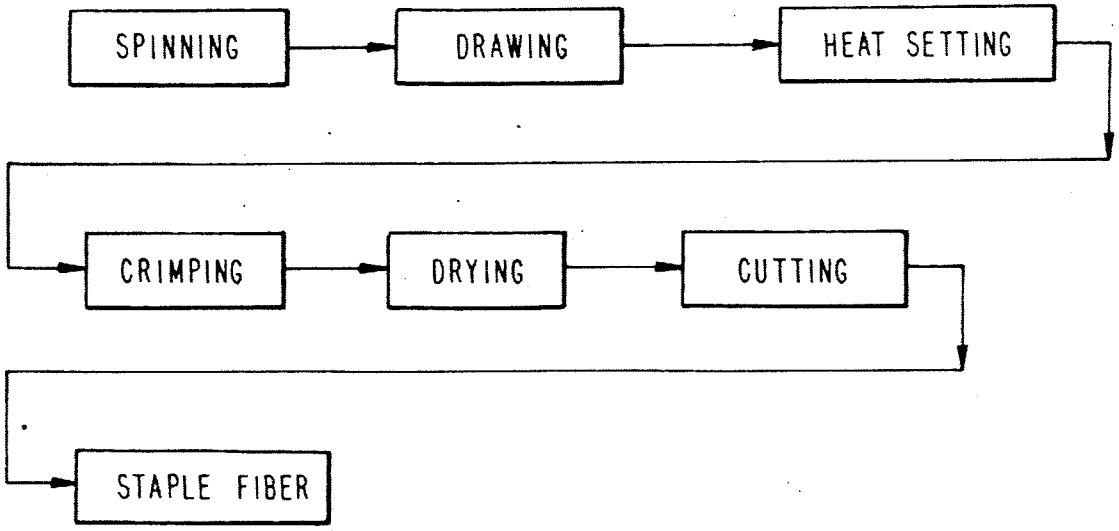
FIG. 5 is a processing procedure chart for the conjugated micro-staple fiber according to this invention.

In the process as shown in FIG. 5, the tow is drawn at 80° C. with a draw ratio of 3.0, after that the drawn tow is subjected to crimping with a crimper following heat setting, being dried at 110° C. and followed by cutting to a conjugated staple fiber of 2.5 d×51 mm. The conjugated staple fiber can be used for forming synthetic leathers through non-woven processing or for forming fabrics by spinning into spun yarn.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

I claim:

1. A process for preparing a conjugated polymer microfilament comprising a polyamide central portion surrounded by a polyester portion, where in a cross-section of the conjugated microfilament the polyamide forms a matrix comprising a plurality of orange-wedge shaped islands all slightly connected at a common center and separated and surrounded by the polyester, the number of polyamide orange-wedge shaped islands being in the range 3 to 12 so that upon an outermost surrounding portion of said polyester being dissolved the remaining polyester and polyamide can be split into 3 to 12 sections of polyester and 3 to 12 sections of polyamide for a corresponding total of 6 to 24 split conjugated filaments of polyester and polyamide, the process comprising the steps of:

separately melting and metering respective flows of said polyester and said polyamide;

extruding said metered flows of melted polyester and polyamide through a conjugated spinneret with the polyester separating the orange-wedge shaped polyamide islands all slighty connected to a common center and separating said islands and surrounding the polyamide, the conjugated fiber being extruded at a temperature at the range 270° to 300° C., a dynamic viscosity during said extrusion being in the range 2000 to 3500 poises for said polyester and in the range 800 to 2500 poises for the polyamide, a take-up speed for the conjugated extruded fiber being in the range 500 to 4000 m/min, and passing the undrawn conjugated yarn obtained from the conjugated spinneret through a belt-nip twister with a draw ratio in the range 1.5 to 4.5, at a speed in the range 300 to 600 m/min, at a drawing temperature in the range 100° to 180° C., said nip twister having a twist level in the range 3000 to 4000 T/M, a belt cross angle in the range 110° to 130°, a ratio of belt speed/yarn speed between 1.62 and 2.2, a second feed roller of said nip twister having an overfeed in the range 1.5 to 2.5%, and a third feed roller of said nip twister having an overfeed in the range 2.0 to 3.5%, the conjugated textured yarn thus obtained having a titer in the range 300 to 450 d and a filament count in the range 12 to 128, with the titer per filament in the range 0.01 to 0.5 d and a sub-resolving ratio=(weight of unsplit yarn−weight of split yarn upon dissolving of an outermost portion of polyester)/(weight of unsplit yarn) being in the range 0.1 to 0.4.

2. A process for preparing a conjugated micro-staple polymer fiber comprising a polyamide surrounded by a polyester wherein, in a cross-section of the conjugated microfilament the polyamide portion has the form of a matrix comprising a plurality of orange-wedge shaped islands all slightly connected at a common center and separated and surrounded by a polyester portion, the number of the orange-wedge shaped polyamide islands being in the range 3 to 12, so that upon dissolving of an outermost surrounding portion of said polyester the remaining polyester and the polyamide can be split into 3 to 12 sections of polyester and 3 to 12 sections of polyamide for the corresponding total of 6 to 24 split conjugated filaments of polyester and polyamide, the process comprising the steps of:

separately melting and metering respective flows of said polyester and said polyamide and then extruding the melted polyamide surrounded by the melted polyester through a conjugated spinneret having between 200 and 300 holes, the conjugated fiber being extruded at a temperature in the range 270° to 300° C., a dynamic viscosity during the spinning being in the range 2000 to 3500 poises for the polyester and in the range 800 to 2500 poises for the polyamide, a take-up speed for the conjugated fiber being extruded from the spinneret being in the range 500 to 1500 m/min;

drawing the extruded conjugated fiber at a draw ratio in the range 3.0 to 4.5, at a drawing temperature of 70° to 120° C.;

heat setting the drawn conjugated fiber at a temperature in the range 40° to 150° C.;

drying the set conjugated fiber, at a drying temperature in the range 60° to 130° C.;

chopping said dried conjugated fiber into 0.5 to 5 d conjugated staple fibers with a length in the range 32 to 102 mm; and spinning the conjugated staple fibers into 20 to 45's spun yarn, with the titer per filament in the range 0.01 to 0.5 d and a sub-resolving ratio=(weight of unsplit yarn−weight of split yarn upon dissolving of an outermost portion of polyester)/(weight of unsplit yarn) being in the range 0.1 to 0.4.

3. A process for preparing a conjugated micro-staple polymer fiber comprising a polyamide surrounded by a polyester wherein, in a cross-section of the conjugated microfilament the polyamide portion has the form of a matrix comprising a plurality of orange-wedge shaped islands all connected at a common center and separated and surrounded by a polyester portion, the number of the orange-wedge shaped polyamide islands being in the range 3 to 12, so that upon dissolving of an outermost surrounding portion of said polyester the remaining polyester and the polyamide can be split into 3 to 12 sections of polyester and 3 to 12 sections of polyamide for the corresponding total of 6 to 24 split conjugated filaments of polyester and polyamide, the process comprising the steps of:

separately melting and metering respective flows of said polyester and said polyamide and then extruding the melted polyamide surrounded by the melted polyester through a conjugated spinneret having between 200 and 300 holes, the conjugated fiber being extruded at a temperature in the range 270° to 300° C., a dynamic viscosity during the spinning being in the range 2000 to 3500 poises for the polyester and in the range 800 to 2500 poises for the polyamide, a take-up speed for the conjugated fiber being extruded from the spinneret being in the range 500 to 1500 m/min;

drawing the extruded conjugated fiber at a draw ratio in the range 3.0 to 4.5, at a drawing temperature of 70° to 120° C.;

heat setting the drawn conjugated fiber at a temperature in the range 40° to 150° C.;

drying the set conjugated fiber, at a drying temperature in the range 60° to 130° C.;

chopping said dried conjugated fiber into 0.5 to 5 d conjugated staple fibers with a length in the range 32 to 102 mm; and forming the conjugated staple fibers into an artificial leather-like material, with the titer per filament in the range 0.01 to 0.5 d and a sub-resolving ratio=(weight of unsplit yarn−weight of split yarn upon dissolving of an outermost portion of polyester)/(weight of unsplit yarn) being in the range 0.1 to 0.4.

* * * * *

UNITED STATES PATENT AND TRADEMARK OFFICE

CERTIFICATE OF CORRECTION

PATENT NO. : 5,047,189

DATED : September 10, 1991

INVENTOR(S) : Chen-Ling LIN

It is certified that error appears in the above-identified patent and that said Letters Patent is hereby corrected as shown below:

Column 5, line 21, change "300" to --30--.

Signed and Sealed this

Eighteenth Day of January, 1994

*Attest:*

*Attesting Officer*

Bruce Lehman

BRUCE LEHMAN

*Commissioner of Patents and Trademarks*